United States Patent [19]

Vinciguerra

[11] Patent Number: 4,730,744

[45] Date of Patent: Mar. 15, 1988

[54] BABY BOTTLE WITH VALVE

[76] Inventor: Mark T. Vinciguerra, 51 E. 23rd St., Riviera Beach, Fla. 33403

[21] Appl. No.: 63,071

[22] Filed: Jun. 17, 1987

[51] Int. Cl.[4] ..... A61J 9/04

[52] U.S. Cl. ..... 215/11.5; 215/11.1

[58] Field of Search ..... 215/11 R–11 E; 251/321, 323, 337, 322; 220/85 V

[56] References Cited

U.S. PATENT DOCUMENTS

| | | | |
|---|---|---|---|
| 1,694,754 | 12/1928 | Porter | 1/11 R |
| 1,732,126 | 10/1929 | Gardner | 215/11 B |
| 1,827,100 | 10/1931 | Pardee | 215/11 B |
| 2,084,099 | 6/1937 | MacCoy | 215/11 B X |
| 2,321,236 | 6/1943 | Parkin | 215/11 R X |
| 2,669,234 | 2/1954 | Baracate | 215/11 D |
| 2,753,068 | 7/1956 | Ribinson | 215/11 D |
| 2,825,479 | 3/1958 | Litzie | 215/11 B |
| 3,768,683 | 10/1973 | Van Dan Bosch | 215/11 B |
| 4,401,224 | 8/1983 | Alonso | 215/11 B |
| 4,545,491 | 10/1985 | Bisgaard et al. | 215/11 D |

FOREIGN PATENT DOCUMENTS

| | | | |
|---|---|---|---|
| 2944279 | 5/1981 | Fed. Rep. of Germany | 215/11 B |
| 1058610 | 11/1953 | France | 215/11 B |
| 121271 | 7/1927 | Switzerland | 215/11 B |

*Primary Examiner*—William Price
*Assistant Examiner*—Sue A. Weaver
*Attorney, Agent, or Firm*—Schwartz, Jeffrey, Schwaab, Mack, Blumenthal & Evans

[57] ABSTRACT

The baby bottle according to the invention has an opening in the base of the bottle. A spring loaded valve is positioned in the opening and cooperates with an O-ring seal on the base. The valve includes a body having a pair of innerconnected, T-shaped channels forming the air inlet. The valve is further recessed in the bottom of the bottle to avoid inadvertent opening or breaking of the valve if the bottle is dropped.

12 Claims, 5 Drawing Figures

BABY BOTTLE WITH VALVE

BACKGROUND OF THE INVENTION

1. Field of the Invention

The invention relates to a baby bottle, and more particularly a baby bottle having valve means in the bottom to admit air.

2. Related Art

Conventional baby bottles have a major disadvantage in that as the baby sucks on the bottle, the nipple collapses. Thus, the infant must periodically release the hold on the nipple to permit air to re-enter the bottle.

It has been recognized that it is desirable to permit air to enter the baby bottle from a valve mechanism. Examples of such prior art devices are found in U.S. Pat. Nos. 1,694,754; 2,669,234; 2,825,479; 3,768,683; 4,401,224; and 4,545,491. The patent appearing to be the closest prior art in appearance, U.S. Pat. No. 3,768,683, has a solid mushroom-shaped valve with the seal thereon. It has the distinct disadvantage in that it will not seat well and will wobble unless the tolerance is so close that the cost would be prohibitive.

OBJECTS AND SUMMARY OF THE INVENTION

It is therefore an object of the present invention to provide a baby bottle with a valve means which will prevent the nipple from collapsing and reduce the chance of the infant developing colic due to excess air intake.

Another object is to provide a simple valve mechanism which will permit air to enter the bottom of the baby bottle and reduce the chance of leakage around the air intake valve.

Still another object is to recess the valve so that it will not be hit if the bottle falls or is dropped.

The baby bottle according to the invention has an opening in the base of the bottle. A spring loaded valve is positioned in the opening and cooperates with an O-ring seal on the base. The valve includes a body having a pair of interconnected, T-shaped channels forming the air inlet. The valve is further recessed in the bottom of the bottle to avoid inadvertent opening or breaking of the valve if the bottle is dropped.

BRIEF DESCRIPTION OF THE DRAWINGS

The above and other objects will be better appreciated from the following description, together with the accompanying drawings wherein.

DETAILED DESCRIPTION OF THE PREFERRED EMBODIMENTS

Figure 1:
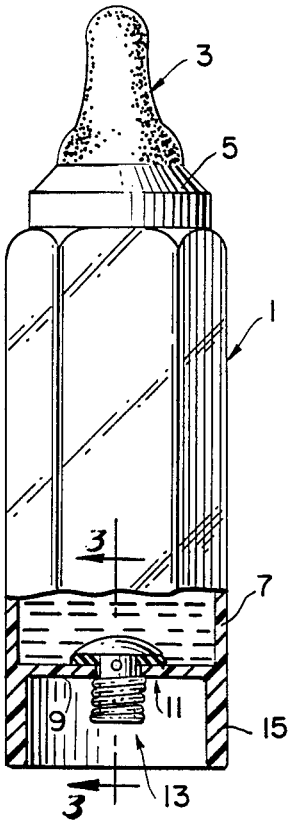
FIG. 1 is a side elevation view of the invention, partly in cross-section.

Referring to the drawings, a bottle 1 includes a nipple 3 connected to the bottle in a conventional manner by a screw-top 5. The bottle has a side wall 7 and a bottom wall or base 9. Positioned in the bottom wall is a valve 11. Formed as an extension of the side wall 7 or in addition thereto is a recess 13 formed by a cylindrical or other similarly configured wall 15.

The valve includes a body having a generally mushroom-shaped portion 17 extending into the interior of the bottle and a second cylindrical body portion 19 extending through an opening 21 in the bottom wall 9. A spring 23 is positioned between the outside of the bottom wall 9 and a ledge 25 on the base of body portion 19.

A pair of interconnected T-shaped channels include a first exterior, longitudinal channel 27 and a second, interior longitudinal channel 29 interconnected by a vertical leg channel 31. Finally, the mushroom portion 17 cooperates with an O-ring seal 33 positioned on the interior of bottom wall.

Figure 2:
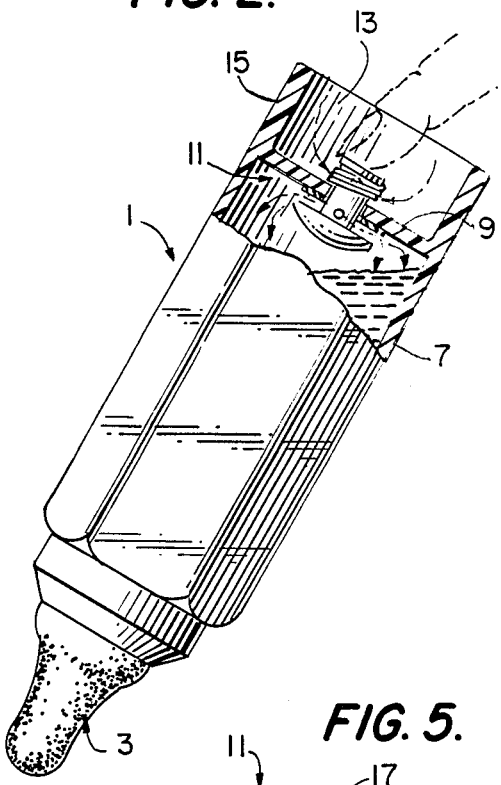
FIG. 2 is a view similar to FIG. 1 showing the bottle inverted and with air flowing into the bottle.
Figure 5:
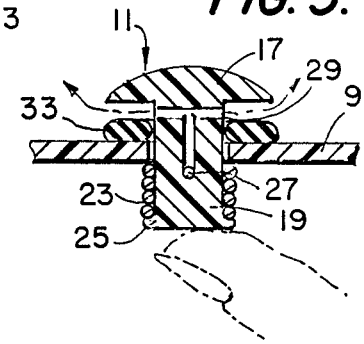
FIG. 5 is a view similar to FIG. 3 with the valve depressed in the manner shown in FIG. 2.
Figure 3:
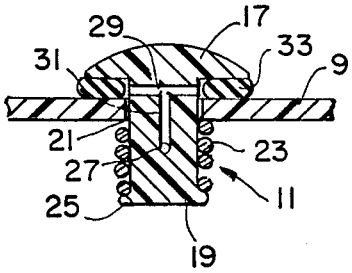
FIG. 3 is a cross-sectional view taken along lines 3—3 in FIG. 1.
Figure 4:
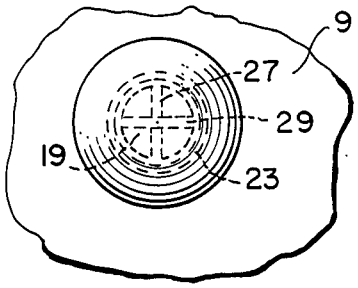
FIG. 4 is a partial bottom view.

In operation, the bottle is filled with liquid in the usual manner and the valve is positioned as seen in FIGS. 1 and 3. When the infant begins to suck on the nipple, the spring, which can be configured such that the negative sucking pressure will be sufficient to overcome the action of spring 23, permits the valve to open as seen in FIGS. 2 and 5. Alternatively, the person holding the infant and bottle can press on the base of the body portion 19, also as seen in FIGS. 2 and 5, causing the valve to open and air to flow through channels 27–31 as seen by the arrows in FIGS. 2 and 5.

While one embodiment of the invention has been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A bottle for feeding a baby, comprising:
   (a) a nipple on the bottle,
   (b) a plurality of walls,
   (c) an opening in the one of said walls, and
   (d) a valve having an open position and a closed position located in said opening, said valve comprising:
      (1) a body having a first portion extending into the interior of the bottle and a second portion extending exterior to the bottle,
      (2) an air inlet extending through said body from the second portion to the first portion,
      (3) seal means cooperating with said first portion and said opening, and
      (4) spring means for urging said first portion toward said one wall to close said opening.

2. The bottle as defined in claim 1 wherein said seal means is an O-ring on said one wall surrounding said opening.

3. The bottle as defined in claim 2 wherein said air inlet in said first portion abuts said seal means when said valve is closed.

4. The bottle as defined in claim 1 wherein said air inlet is formed by a pair of interconnected, T-shaped channels.

5. The bottle as defined in claim 1 wherein one of said walls is a bottom wall and wherein said valve is positioned in said bottom wall.

6. The bottle as defined in claim 5 including means in said bottom wall for recessing said valve.

7. The bottle as defined in claim 1 wherein said valve body is generally mushroom-shaped.

8. The bottle as defined in claim 1 wherein said spring means has a tension force equal to slightly less than the normal sucking force of an infant.

9. The bottle as defined in claim 1 wherein said seal means is an O-ring surrounding said opening on the interior of said bottom wall, and said inlet is in the form of a pair of interconnected, T-shaped channels having one channel abutting said seal means when said valve is closed.

10. The bottle as defined in claim 9 including means in said bottom wall for recessing said valve.

11. The bottle as defined in claim 9 wherein said valve body is generally mushroom-shaped.

12. The bottle as defined in claim 9 wherein said spring means has a tension force equal to slightly less than the normal sucking force of an infant.

* * * * *